United States Patent [19]

Player et al.

[11] 4,232,834

[45] Nov. 11, 1980

[54] ROLL CRUSHER

[75] Inventors: Duane W. Player, Salt Lake City, Utah; James A. Weil, Plymouth, Minn.

[73] Assignee: Minneapolis Electric Steel Castings Company, Minneapolis, Minn.

[21] Appl. No.: 65,836

[22] Filed: Aug. 13, 1979

[51] Int. Cl.[3] ..... B02C 4/30

[52] U.S. Cl. ..... 241/293; 29/123; 29/129.5

[58] Field of Search ..... 241/291, 293, 294, 300, 241/197; 29/123, 129.5

[56] References Cited

U.S. PATENT DOCUMENTS

| | | | |
|---|---|---|---|
| 50,247 | 10/1865 | Hitchock | 241/295 |
| 256,628 | 4/1882 | Birkholz | 241/295 |
| 384,172 | 6/1888 | Noyes | 241/294 |
| 480,937 | 8/1892 | Penfield | 241/293 |
| 661,617 | 11/1900 | McCanna | 241/294 |
| 672,617 | 4/1901 | Edison | 241/222 |
| 721,208 | 2/1903 | Madge | 241/294 |
| 745,640 | 12/1903 | Mason, Jr. | 241/294 |
| 795,331 | 7/1905 | Brinton | 241/294 |
| 993,783 | 5/1911 | Mason, Jr. | 241/295 |
| 1,028,550 | 6/1912 | Cunningham | 241/119 |
| 1,087,204 | 2/1914 | Washburne | 241/295 |
| 1,538,703 | 5/1925 | Johnston | 241/295 |
| 2,097,982 | 11/1937 | Kist et al. | 241/295 |
| 2,269,552 | 1/1942 | Ratkowski et al. | 241/294 |
| 2,294,098 | 8/1942 | Stromer | 241/294 |
| 2,798,676 | 7/1957 | Heer | 241/294 |
| 2,904,251 | 12/1960 | Samuels et al. | 235/132 A |
| 3,090,105 | 5/1963 | Gibbar et al. | 241/294 |
| 3,138,338 | 6/1964 | McKenna | 241/294 |
| 3,388,871 | 6/1968 | Gundlach | 241/294 |
| 3,721,391 | 3/1973 | Lepola | 241/294 |

*Primary Examiner*—Richard B. Lazarus

*Attorney, Agent, or Firm*—Merchant, Gould, Smith, Edell, Welter & Schmidt

[57] ABSTRACT

The disclosure is directed to an improved roll crusher comprising a central hub mounted on a rotatable shaft, a roll member carried by the hub in concentric relation thereto, and a pair of clamping rings for securing the components together. The roll member and hub have angular surfaces disposed in opposed relation to define a pair of annular, axially facing recesses having V-shaped sides. The clamping rings are constructed to fit into the recesses, each defining inner and outer circumferential surfaces which are angled to correspond to the angled surfaces of the hub and roll member. A plurality of equiangularly spaced bolts connect the clamping rings and hub, drawing the clamping rings toward each other to wedge the roll member radially outward relative to the hub. As a result, the roll member is fixed in a centered, balanced position relative to the hub. A plurality of lugs and lug receiving recesses cooperate to prevent relative rotation between the roll member and hub. The roll member is formed from material which offers substantially greater resistance to abrasion than the material of the hub.

18 Claims, 6 Drawing Figures

FIG. 1
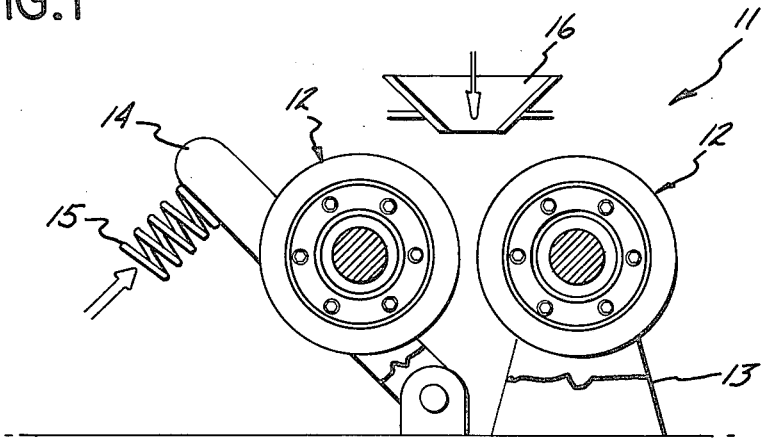
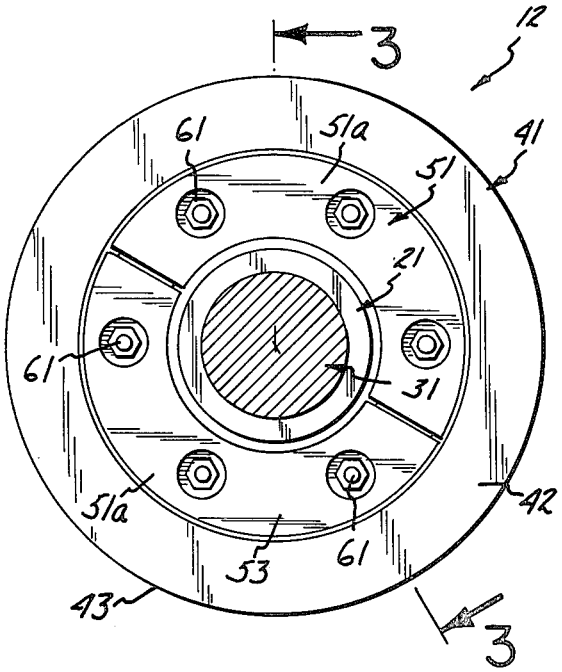
FIG. 2
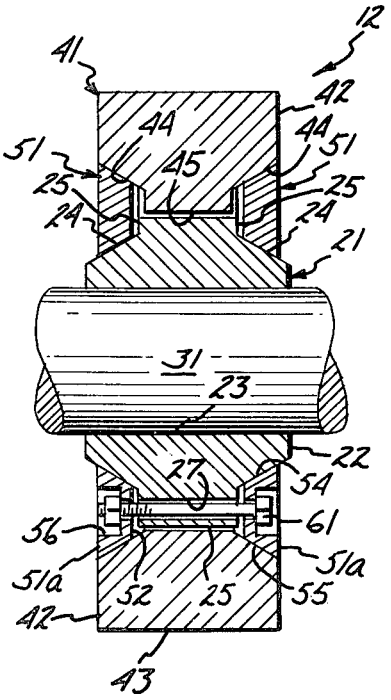
FIG. 3

ROLL CRUSHER

TECHNICAL FIELD

The invention relates generally to roll crushers which are used in pairs to reduce the size of ore fragments. The invention is specifically directed to an improved roll crusher having a hardened roll member which may be replaced after wear.

BACKGROUND OF PRIOR ART

Roll crushing apparatus have long been used as an initial step in an ore comminution process. Typically, the function of the roll crushing apparatus is to initially break up the large ore fragments into smaller fragments, which are thereafter further comminuted by other processes.

Roll crushing apparatus typically consists of two roll crushers mounted for rotation about parallel axes. The roll crushers are disposed with their outer circumferential crushing surfaces spaced apart an amount corresponding to the size of the desired output product. Generally, one of the roll crushers is rotatably driven about a stationary axis, with the other freely rotatable on a mounting which is spring biased toward the first.

A roll crusher design which has enjoyed substantial commercial success utilizes a hub upon which a replaceable, annular roll member is mounted. The hub has a circumferential surface that defines a shallow, concave V, one tapered surface of which is defined by a removable clamping ring. The inner circumference of the roll member has a complementing, slightly projecting V-shaped surface. With the clamping ring removed, the roll member is placed on the hub. The clamping ring is then mounted, which exerts some degree of wedging force against the roll member. However, this force is not sufficient to restrain relative rotational movement between the roll member and hub during operation. Consequently, the roll member is heat shrunk on through the use of a furnace.

Several problems result from this structural configuration. First, because heat shrinking is required, the roll member cannot be made from material having a high Brinnell hardness or which offers good resistance to abrasion. Extremely hard, abrasion resistant materials are preferable for crushing operations, but they are extremely brittle and cannot withstand the internal stress forces created during the heat shrinking process. As a result, the roll member for this type of prior art device has been made from material which is of only moderate hardness.

Second, for successful heat shrinking to take place, the V-shaped engaging surfaces of the roll member and hub must be machined to fairly close tolerances, which is difficult and time consuming for an article of this nature. Typically, the roll member itself has an outside diameter of four feet and weighs approximately two tons.

Thirdly, replacement of a worn roll member, which is frequently necessary because of its moderate hardness, is difficult, time consuming and somewhat dangerous due to the extreme heat necessary for proper heat shrinking to occur. Often times, the initial steps of removing the clamping ring and roll member themselves are extremely difficult because of the heat shrunk, close tolerance fit, coupled with peening of the roll member that occurs during the crushing process.

The need for frequent replacement of worn roll members is a negative economic factor. Ore processing plants are often run on a 24 hour continuous basis. The relatively rapid wear of the roll member, which necessitates replacement of the entire component, coupled with the downtime necessary for its replacement, results in a very costly operation.

A number of prior art devices have employed roll members formed from material which is harder than the supporting hub, and which requires less frequent replacement. However, each has employed a structural approach which is either unwieldy from the standpoint of roll member replacement, requires the roll member to be made from a plurality of segments, or does not insure that the newly replaced roll member will be centered and balanced on the hub.

BRIEF SUMMARY OF THE INVENTION

The subject invention contemplates a roll crusher that wears much longer and is much more easily replaced. The inventive roll crusher has a central hub, a roll member formed from hard, abrasion resistant material, means for preventing relative rotation between the hub and roll member, and a pair of clamping rings that operate to center the roll member on the hub in a fixed, balanced position that does not require heat shrinking.

The advantages of a roll member formed from a material which is highly resistant to abrasion are economically significant. Such material has a much longer wear life and need not be replaced nearly as frequently as materials which are tough but have lesser resistance to abrasion. In addition to the simple saving from use of lesser material, the roll crushing machinery has a significantly decreased downtime and operates a higher percentage of the time. Further, there is no need for a furnace to heat shrink the roll member onto the hub.

This is accomplished by providing the hub and roll member with opposed circumferential surfaces which are angled to define annular recesses. The recesses face axially outward and have V-shaped sides.

A clamping ring is provided for each annular recess, each ring having inner and outer circumferential edges that are angled in conformance to the angled surfaces of the recess. Nut and bolt assemblies extend commonly through the clamping rings and the hub, and are tightened to draw the clamping rings together, thus urging the roll member radially outward from the hub. Due to this structural arrangement, the roll member is automatically centered relative to the hub in a balanced position.

Lugs and lug receiving recesses between the hub and roll member prevent relative rotation therebetween and serve to transmit torque from the hub to the roll member. In this manner, it is not necessary to rely on the friction between the angled surfaces to transmit torque.

Sufficient clearance is provided between the cooperating surfaces of the hub and roll member to insure that the roll member may easily slide off of and onto the hub. Thus, the difficult task of machining the abrasion resistant material, from which the roll member is fabricated, is obviated.

The result is a roll crusher which has a significantly increased wear life, but also which is quickly and easily replaced when a change is necessary.

BRIEF DESCRIPTION OF THE DRAWINGS

FIG. 1 is a generally schematic representation of roll crusher apparatus employing two roll crushers embodying the subject invention;

FIG. 2 is an enlarged side elevational view of the inventive roll crusher, which comprises a hub mounted on a shaft, a roll member and a pair of clamping rings;

FIG. 3 is a sectional view of the roll crusher taken along the line 3—3 of FIG. 2;

DESCRIPTION OF THE PREFERRED EMBODIMENT

Figure 4:
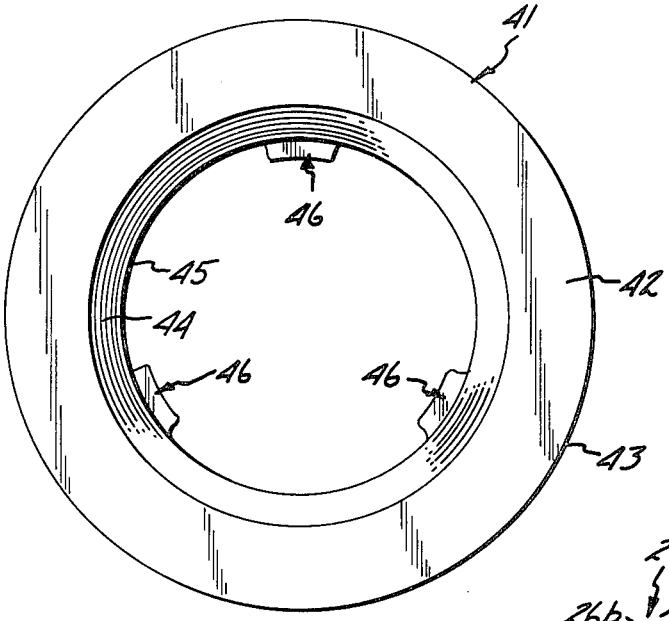
FIG. 4 is a side elevational view of the roll member.

With initial reference to FIG. 1, a roll crushing apparatus 11 includes two roll crushers 12, both of which embody the invention. One of the roll crushers 12 is carried on a stationary mount 13 and rotatably driven by means not shown. The other roll crusher 12 is carried on a pivotally movable mount 14 that is normally urged toward the other roll crusher 12 by a variable spring force 15. This roll crusher 12 rotates freely on the movable mount 14 about an axis that is parallel to that of the cooperating crusher 12.

Spacing between the roll crushers 12, as determined by the spring force 15, determines the size of ore fragments as they leave the apparatus 11. Larger ore fragments are introduced into the apparatus through a hopper 16.

FIGS. 2-6 specifically disclose the construction of the roll crushers 12. Each broadly comprises a hub 21 mounted on a shaft 31, a roll member 41 mounted on the hub in concentric relation and a pair of split clamping rings 51.

With specific reference to FIGS. 3 and 5, the hub 21 is of annular configuration, defining opposed, planar axial end faces 22, a central bore 23 which conforms to the outer diameter of shaft 31 and an outer circumferential support surface which is described in further detail below.

In the preferred embodiment, the hub 21 is heat shrunk onto the shaft 31 and becomes an essentially permanent component of the roll crusher 12. In contrast, and as will become apparent below, the roll member 41 is mounted in such a manner that it may be easily replaced as it becomes worn through the roll crushing process.

The outer circumferential support surface of the hub defines first and second angular shoulders 24 that incline radially inward (relative to the hub axis) to the respective axial end faces 22. Centrally disposed between the angular shoulders 24 is a circumferential land 25 that projects radially outward beyond the angular shoulders 24. As is best shown in FIG. 3, the top circumferential surface of the land 25 is flat.

Figure 5:
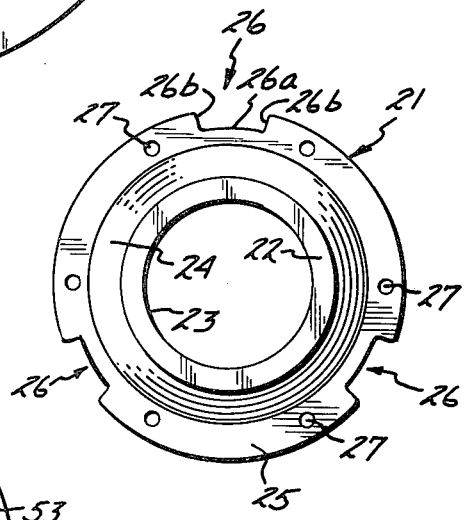
FIG. 5 is a side elevational view of the hub.

Three equiangularly spaced recesses 26 are formed in the land 25 (FIG. 5). Each of the recesses 26 is defined by a slightly convex bottom 26*a* and sides 26*b* which are disposed in substantial alignment with radii of the hub 21.

Six equiangularly spaced, axially extending bores 27 are formed through the land 25 for mounting purposes, as will become apparent below. As is shown in FIG. 5, there are two of the mounting bores 27 disposed in each of the arcuate segments of the land 25 defined between adjacent recesses 26.

With reference to FIGS. 2, 3 and 4, the roll member 41 is also of annular configuration, defining axial end faces 42, an inner circumferential mounting surface described in detail below, and an outer circumferential roll crushing surface 43 which is flat in the preferred embodiment.

The inner circumferential mounting surface of roll member 41 defines first and second angular surfaces 44 that incline radially outward (relative to the roll member axis) to the respective axial end faces 42. The circumferential mounting surface also has a circumferential land 45 centrally disposed between the angular surfaces 44, but it does not project radially beyond the surfaces 44. In the preferred embodiment, the land 45 is flat (FIG. 3) and it has a width which corresponds to the land 25 of hub 21.

Three equiangularly spaced lugs 46 are formed as an integral part of the roll member 41 and project radially inward from the circumferential land 45. The size of the lugs 46 generally corresponds to that of the recesses 26.

The size relationship of the outer circumferential land 25 of hub 21 to the inner circumferential land 45 of roll member 41 permits a reasonable degree of clearance (see FIG. 3), so that the roll member 41 may slide easily onto and off of the hub 21 during replacement. The size relationship between the lugs 46 and lug recesses 26 is similar, while at the same time permitting the hub 21 to efficiently transfer torque to the roll member 41 through the lugs 46.

Figure 6:
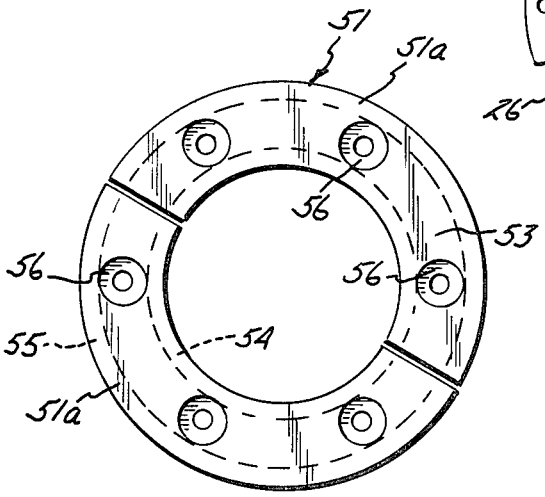
FIG. 6 is a side elevational view of one of the split clamping rings for the roll crusher.

The hub 21 and roll member 41 are held in centered, fixed relation by the clamping rings 51, which are specifically shown in FIGS. 2, 3 and 6. In the preferred embodiment, each clamping ring 51 is split into semicircular segments 51*a* for purposes of manufacturing and installation convenience. However, such ring could be fabricated in a single annular ring, or more than two arcuate segments, without departing from the invention.

Each of the clamping rings 51 defines an inner axial face 52 and an outer axial face 53, which in the preferred embodiment are flat, annular surfaces disposed in parallel relation.

Each clamping ring further defines a radially inner circumferential surface or edge 54 which is angled in conformance to the angular shoulder 24 of hub 21. Each clamping ring 51 also defines an outer circumferential surface or edge 55 which is angled in conformance to the angular surface 44 of roll member 41.

With the hub 21 and roll member 41 in the assembled relation shown in FIG. 3, the angular shoulders 24 and angular surfaces 25 define axially facing, annular recesses having converging or V-shaped sides. The thickness or axial dimension of each clamping ring 51 generally corresponds to but is somewhat less than the depth of these annular recesses. Thus, each of the clamping rings 51 may be inserted into the recess, and when urged axially inward, the clamping rings 51 act as a wedge to force the roll member 41 radially outward relative to the hub 21. At the same time, due to the relationship of components, the clamping rings 51 insure that the roll member 41 is centered on the hub 21 to prevent unbalanced rotation.

The wedging function is provided by six mounting nut and bolt assemblies 61 which commonly pull the clamping rings 51 together. To this end, each of the clamping rings 51 is formed with six equiangularly spaced and counterbored mounting openings 56 which register with the mounting bores 27. The bolt head and nut of the assembly 61 are received in the counterbores (FIG. 3). The fact that each nut and bolt assembly 61 commonly draws the clamping rings 51 together, and the symmetrical, equiangular spacing of the nut and bolt assemblies 61 assures that the roll member 43 will uniformly urge the roll member 43 radially outward to obtain the necessary concentric, balanced relationship between the roll member 41 and hub 21. This is substantially assisted by the provision of two pairs of coacting angular surfaces (surface 24 with surface 54, and surface 44 with surface 55), which generate uniform, balanced forces within the assembly.

One of the primary advantages resulting from the construction described above is formation of the roll member 41 from a material which has an excellent abrasion resistance. Materials of this type wear much longer and need to be replaced much less frequently. However, they are generally brittle, and cannot withstand the severe temperatures encountered during the heat shrinking process. Further, because of their hardness, they are very difficult to machine.

The unique construction and interrelationship of the hub 21, roll member 41 and clamping rings 51 obviates the need to heat shrink the roll 41, and also enables the roll member 41 to define sufficient clearance with the hub 21 so that close tolerance maching is unnecessary.

Because the hub 21 is not exposed to the ore crushing process, it need not be made from hard, brittle material. Consequently, it is convenient and economical to heat shrink the hub 21 onto the shaft 31 as described above.

In the preferred embodiment, the roll member 41 is formed from martensitic white iron or martensitic steel having a Brinnell hardness number of at least 600.

In contrast, the hub 21 and clamping rings 51 are formed from a material which has a lesser resistance to abrasion, but which offers greater toughness and is more machinable. In the preferred embodiment, the hub 21 and clamping rings 51 are made from 4135 steel which is heat treated to a Brinnell hardness number of 250–300.

A worn roll member 41 is replaced by loosening and removing the nut and bolt assembly 61 and removing the clamping rings 51. The roll member 41 itself is removed with the aid of a crane or lift, and a new one replaced on the hub 21. Replacement of the same clamping rings 51, coupled with uniform tightening of the nut and bolt assembies 61, fixes the roll member 41 in a centered, balanced position relative to the hub 21.

What is claimed is:

1. A roll crusher comprising:

(a) a hub constructed for mounting on a drive shaft, the hub being of annular configuration and defining axial end faces and an outer circumferential support surface;

(b) a replaceable roll member of annular configuration sized for mounting on the hub in concentric relation therewith, the roll member defining axial end faces, an outer circumferential roll crushing surface and an inner circumferential mounting surface;

(c) the support surface of the hub defining first and second angular shoulders that incline radially inward to the respective axial end faces of the hub;

(d) the mounting surface of the roll member defining first and second angular surfaces that incline radially outward to the respective axial end faces of the roll member;

(e) the first and second angular shoulders respectively disposed in opposed relation to the first and second angular surfaces to define first and second annular recesses having converging sides and each facing axially outward;

(f) means associated with the support and mounting surfaces for preventing relative rotation between the hub and roll member in assembled relation;

(g) a clamping ring for each of said annular recesses, each clamping ring having opposed inner and outer circumferential surfaces that are angled to matably cooperate with the converging sides of the associated recess;

(h) and connecting means for axially urging each clamping ring into the recess to wedge the roll member radially outward relative to the hub.

2. The roll crusher defined by claim 1, wherein the supporting surface comprises a centrally disposed circumferential first land disposed between the angular shoulders;

(a) and the mounting surface comprises a centrally disposed circumferential second land disposed between the annular surfaces;

(b) the first and second lands being of generally complementing size and shape, and disposed in radial opposition.

3. The roll crusher defined by claim 2, wherein the first land projects radially beyond the angular surfaces.

4. The roll crusher defined by claim 3, wherein:

(a) the first circumferential land has a plurality of mounting bores extending axially therethrough;

(b) each clamping ring has a like number of axially extending openings registrable with the axial bores of the hub land;

(c) and the connecting means comprises a like plurality of mounting bolts each of which extends through both of said clamping rings and the hub land.

5. The roll crusher defined by claim 4, wherein the axial mounting bores of the hub land are equiangularly spaced.

6. The roll crusher defined by claim 2, wherein the lands of the supporting and mounting surfaces are flat.

7. The roll crusher defined by claim 2, wherein the rotation preventing means comprises:

(a) a plurality of lugs projecting radially from one of the first and second lands;

(b) and a like plurality of lug receiving recesses formed in the other of said lands.

8. The roll crusher defined by claim 2, wherein the hub and roll member each has a symmetrical cross section.

9. The roll crusher defined by claim 1, wherein the roll member is formed from material having a greater resistance to abrasion than the material of the hub.

10. The roll crusher defined by claim 1, wherein the roll member is formed from material having a greater Brinnell hardness than the material of the hub.

11. The roll crusher defined by claim 10, wherein the material of the roll member has a Brinnell hardness number of at least 600, and the material of the hub and clamping rings has a Brinnell hardness number of 250–300.

12. The roll crusher defined by claim 1, wherein the roll member is formed from martensitic white iron.

13. The roll crusher defined by claim 1, wherein the roll member is formed from martensitic steel.

14. The roll crusher defined by claim 1, wherein the clamping ring comprises a plurality of arcuate segments.

15. The roll crusher defined by claim 14, wherein the clamping ring comprises two identical semicircular segments.

16. The roll crusher defined by claim 1, wherein the connecting means comprises a plurality of mounting bolts.

17. The roll crusher defined by claim 16, wherein the mounting bolts commonly interconnect the clamping rings.

18. The roll crusher defined by claim 1, wherein the roll member is cast as a single piece.

* * * * *